US010865458B2

(12) United States Patent
Zhao et al.

(10) Patent No.: US 10,865,458 B2
(45) Date of Patent: Dec. 15, 2020

(54) ARMOR PLATE WITH 2000 MPA-GRADED TENSILE STRENGTH, AND MANUFACTURING METHOD THEREFOR

(71) Applicant: BAOSHAN IRON & STEEL CO., LTD., Shanghai (CN)

(72) Inventors: Xiaoting Zhao, Shanghai (CN); Fengbin Li, Shanghai (CN); Liandeng Yai, Shanghai (CN); Hongbin Li, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 257 days.

(21) Appl. No.: 15/754,688

(22) PCT Filed: Aug. 25, 2016

(86) PCT No.: PCT/CN2016/096636
§ 371 (c)(1),
(2) Date: Feb. 23, 2018

(87) PCT Pub. No.: WO2017/036338
PCT Pub. Date: Mar. 9, 2017

(65) Prior Publication Data

US 2018/0265942 A1 Sep. 20, 2018

(30) Foreign Application Priority Data

Aug. 28, 2015 (CN) ..... 2015 1 0539848

(51) Int. Cl.
*C21D 9/42* (2006.01)
*C22C 38/54* (2006.01)
(Continued)

(52) U.S. Cl.
CPC ..... *C21D 9/42* (2013.01); *C21D 6/004* (2013.01); *C21D 6/005* (2013.01); *C21D 6/008* (2013.01);
(Continued)

(58) Field of Classification Search
CPC ..... C21D 9/42; C21D 6/004; C21D 8/0226; C22C 38/50; C22C 38/02
See application file for complete search history.

(56) References Cited

U.S. PATENT DOCUMENTS

2012/0174749 A1* 7/2012 Stumpf ..... C21D 6/002 89/36.02
2016/0208352 A1* 7/2016 Suikkanen ..... C22C 38/002

FOREIGN PATENT DOCUMENTS

BD 19508947 A1 9/1996
CN 1308144 8/2001
(Continued)

OTHER PUBLICATIONS

PCT/CN2016/096636 International Search Report and Written Opinion, dated Dec. 1, 2016; PCT/CN2016/096636 PCT Request dated Aug. 25, 2016 and PCT Notification.
(Continued)

*Primary Examiner* — Christopher S Kessler
*Assistant Examiner* — Jiangtian Xu
(74) *Attorney, Agent, or Firm* — Thomas Horstemeyer, LLP

(57) ABSTRACT

A bulletproof steel plate with a tensile strength of 2000 MPa grade and a Brinell Hardness of 600 grade and a manufacturing method thereof, characterized by that the chemical elements in mass percentage thereof being: 0.35-0.45% of C, 0.80-1.60% of Si, 0.3-1.0% of Mn, 0.02-0.06% of Al, 0.3-1.2% of Ni, 0.30-1.00% of Cr, 0.20-0.80% of Mo, 0.20-0.60% of Cu, 0.01-0.05% of Ti, 0.001-0.003% of B,
(Continued)

and the balance being Fe and inevitable impurities. The tensile strength of the steel plate can reach a grade of 2000 MPa and its Brinell Hardness can reach a grade of 600.

7 Claims, 1 Drawing Sheet

(51) Int. Cl.

| | |
|---|---|
| ***C21D 8/02*** | (2006.01) |
| ***F41H 5/04*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/50*** | (2006.01) |
| ***F41H 5/02*** | (2006.01) |

(52) U.S. Cl.
CPC ..... *C21D 8/02* (2013.01); *C21D 8/0205* (2013.01); *C21D 8/0226* (2013.01); *C21D 8/0263* (2013.01); *C22C 38/02* (2013.01); *C22C 38/04* (2013.01); *C22C 38/06* (2013.01); *C22C 38/42* (2013.01); *C22C 38/44* (2013.01); *C22C 38/50* (2013.01); *C22C 38/54* (2013.01); *F41H 5/02* (2013.01); *F41H 5/0442* (2013.01); *C21D 2211/008* (2013.01)

(56) References Cited

FOREIGN PATENT DOCUMENTS

| | | | |
|---|---|---|---|
| CN | 103993235 | A | 8/2014 |
| CN | 105088090 | A | 11/2015 |
| JP | 2015533942 | | 11/2015 |
| WO | 0148256 | A1 | 7/2001 |

OTHER PUBLICATIONS

Japanese Office Action dated Dec. 11, 2018 in copending Japanese Patent Application No. JP 20180511059 filed Aug. 25, 2016.

* cited by examiner

ARMOR PLATE WITH 2000 MPA-GRADED TENSILE STRENGTH, AND MANUFACTURING METHOD THEREFOR

CROSS-REFERENCE TO RELATED APPLICATIONS

This application is a 371 U.S. National Phase of PCT International Application No. PCT/CN2016/096636, filed on Aug. 25, 2016, which claims benefit and priority to Chinese patent application No. 201510539848.6, filed on Aug. 28, 2015. Both of the above-referenced applications are incorporated by reference herein in their entirety.

TECHNICAL FIELD

The present invention relates to a steel material and a manufacturing method for the steel material, and particularly to a bulletproof steel plate and a manufacturing method for the bulletproof steel plate.

BACKGROUND ART

With the serious anti-terrorism situation at home and abroad, the demand for armoured vehicles with bulletproof properties has been increasing year by year. In addition, the demand for armour steel plates for higher bulletproof grade requirements also increases. Besides, in daily life, there is a further need for some steel plates to be manufactured into bulletproof doors, bulletproof helmets, bulletproof vests and bulletproof shields which have bullet-proofing and shooting-proofing functions, or to be manufactured into bulletproof components of devices such as bank counters, confidential safes, anti-riot vehicles, bulletproof cash carriers, submarines, landing crafts, anti-smuggling vessels, helicopters.

A Chinese patent document with publication No. CN 101270439 A, published on 24 Sep. 2008 and entitled "High-Strength Hot-Rolled Bulletproof Steel Plate and Manufacturing Method for the Bulletproof Steel Plate", discloses a high-strength hot-rolled bulletproof steel plate and a manufacturing method for the high-strength hot-rolled bulletproof steel plate. The method for manufacturing the high-strength hot-rolled bulletproof steel plate comprises the steps of: heating a steel billet at 1150-1250° C. followed by rolling, with the rolling reduction being greater than 80% and the finish rolling temperature being 830-900° C., cooling the finish rolled steel plate at a cooling rate of 20° C./s to 460-560° C. for coiling, and further air cooling the steel plate to room temperature. The composition of the bulletproof steel plate obtained by the manufacturing method comprises 0.15-0.22% of C, 0.2-0.6% of Si, 1.6-2.2% of Mn, P≤0.035%, S≤0.01%, 0.020-0.06% of Al, N≤0.006%, 0.025-0.15% of Ti, Cu<0.3%, Nb≤0.055% and/or V≤0.15% or one or more of Cr<0.3%, Mo<0.3%, Ni<0.2%, Ca<0.0050% and B<0.0025%, and the balance being Fe and inevitable impurities. The thickness of the bulletproof steel plate is not greater than 3 mm, and the tensile strength is not relatively high.

A Chinese patent document with publication No. CN 102181795 A, published on 14 September 2011 and entitled "Ultrahigh-Strength Bulletproof Steel Plate and Manufacturing Method for the Ultrahigh-Strength Bulletproof Steel Plate" discloses an ultrahigh-strength bulletproof steel plate and a manufacturing forming process for the ultrahigh-strength bulletproof steel plate. The chemical elements (in wt. %) in the ultrahigh-strength bulletproof steel plate are: 0.30-0.5 of C, 0.40-0.60 of Si, 1.50-1.80 of Mn, P≤0.025, S≤0.01, Cr+Ni+Mo≤2.5, Nb+V+Ti+B≤0.20 and the balance being Fe. The ultra-high strength bulletproof steel plate is prepared using a low alloy composition design, and relates to heating at 1180-1250° C., starting rolling at 1000-1150° C., finishing rolling at 850-900° C. and a heat treatment at 900-950° C.; moreover, a heat stamping forming process with introduced water cooling is used, wherein water flows into a die at a pressure of 7-8 bar and exits at a pressure of 5.5-7 bar, with the flow rate of water being 1.5-3 m/s, whereby obtaining a 2.2 mm thick B-grade ultrahigh-strength light-weight bulletproof steel plate and a 3.7 mm thick C-grade ultrahigh-strength light-weight bulletproof steel plate, which meet various performance requirements and have a good plate-shape flatness without any oxide skin on surface. The bulletproof steel plate disclosed in this patent document contains no Cu element, and the thickness of the bulletproof steel plate is 3 mm or less.

A Chinese patent document with publication No. CN 103993235 A, published on 20 Aug. 2014 and entitled "High-Strength Hot-Rolled Bulletproof Steel Plate and Manufacturing Method for the High-Strength Hot-Rolled Bulletproof Steel Plate", discloses a method for manufacturing a high-strength hot-rolled bulletproof steel plate. The method for manufacturing the high-strength hot-rolled bulletproof steel plate comprises the steps of: 1) smelting and casting components to obtain a continuous cast slab acceptable in composition, and sending the continuous cast slab to a heating furnace for heating; 2) hot-rolling the heated continuous cast slab; 3) cooling the hot-rolled continuous cast slab; 4) coiling the cooled continuous cast slab to obtain a hot-rolled plate; and 5) subjecting the hot-rolled plate to a heat treatment to obtain a bulletproof steel plate. The chemical elements of the bulletproof steel plate obtained by the manufacturing method are: 0.08-0.12% of C, 0.7-1.3% of Si, 1.30-1.8% of Mn, 0.01-0.06% of Al, P≤0.02%, S≤0.004%, N≤0.004%, 0≤0.015%, 0.3-1.0% of Cr, Ti+Nb≤0.2%, 0.0015-0.0025% of B, and the balance being Fe and inevitable impurities. The thickness of the bulletproof steel plate disclosed in this patent document does not exceed 3 mm, and the Brinell hardness of the bulletproof steel plate after quenching and tempering treatments reaches merely a grade of about 500.

SUMMARY OF THE INVENTION

An object of the present invention lies in providing a bulletproof steel plate with a tensile strength of 2000 MPa grade and a Brinell Hardness of 600 grade, which has a higher tensile strength and a higher Brinell hardness. In addition, the bulletproof steel plate further has a good atmospheric corrosion resistance.

In order to achieve the above-mentioned object, the present invention provides a bulletproof steel plate with a tensile strength of 2000 MPa grade and a Brinell Hardness of 600 grade, the chemical elements in mass percentage of which being:

0.35-0.45% of C;
0.80-1.60% of Si;
0.3-1.0% of Mn;
0.02-0.06% of Al;
0.3-1.2% of Ni;
0.30-1.00% of Cr;
0.20-0.80% of Mo;
0.20-0.60% of Cu;
0.01-0.05% of Ti;
0.001-0.003% of B;

and the balance being Fe and other unavoidable impurities.

The principle of the design of the chemical elements in the bulletproof steel plate with a tensile strength of 2000 MPa grade and a Brinell Hardness of 600 grade of the present invention is as follows:

Carbon: C has the function of solid solution strengthening in steel, contributes the most to increasing the strength of the steel and C is also the lowest-cost reinforcing element. In order to achieve a certain level of hardness, the steel needs to contain a higher content of C. However, if the content of C is too high, the welding performance and toughness of the steel plate will both be unfavourable. Considering the matching of the strength and toughness of the steel plate, the content of C in the bulletproof steel plate of the present invention should be controlled at 0.35-0.45%.

Silicon: Si is an element for deoxidization. In addition, Si can also be dissolved in ferrite, and thus has the function of solid solution strengthening, thereby significantly improving the strength and hardness of the steel plate. The solid solution strengthening effect of Si is only second to that of carbon, nitrogen and phosphorus, but superior to other alloying elements. In order to make full use of the solid solution strengthening effect of Si, the content of Si is generally not less than 0.6%. With regard to the bulletproof steel plate of the present invention, the content of Si needs to be controlled within a range of 0.8% to 1.60%, so as to exert the effect of solid solution strengthening.

Manganese: Mn can reduce the critical cooling rate, and greatly improve the hardenability. In addition, Mn has a solid solution strengthening effect on the steel plate. If the content of Mn is too high, the transformation temperature of martensite will decrease too much, resulting in the increase of residual austenite at room temperature, which is not conducive to the increase of the strength of the steel plate. In addition, the formation of coarse MnS at the central segregation site of the cast slab can also reduce the toughness at the centre of the thickness of the plate. Based on the technical solution of the present invention, the content of Mn in the bulletproof steel plate needs to be set to 0.30-1.00%.

Aluminium: Al is also used as an element for deoxidization. Al and nitrogen may form fine insoluble AlN particles, which can refine the microstructure of the steel plate. In addition, Al can also inhibit the formation of BN, so that B is present in a solid solution state, so as to ensure the hardenability of the steel plate. Where the content of Al is too high, coarse aluminium oxide inclusions are formed in the steel. In view of this, the content of Al in the bulletproof steel plate of the present invention should be 0.02-0.06%.

Nickel: Ni in steel is only soluble in the matrix phase ferrite and austenite, and does not form any carbide. Ni has a very strong austenite stabilizing effect, and is also a main element that ensures the high toughness of the steel plate. Comprehensively considering the effect of Ni element in the bulletproof steel plate of the present invention and the alloying element addition cost factor, the content of Ni should be set in the range of 0.3% to 1.2%.

Chromium: Cr is not only an element that reduces the austenite phase region, but also is soluble in ferrite. Cr can improve the stability of austenite, making the C curve move to the right, thereby reducing the critical cooling rate in order to improve the hardenability of the steel. In the bulletproof steel plate of the present invention, the content of Cr should be controlled at 0.30-1.00%.

Molybdenum: Mo is present in the solid solution phase in the steel, and therefore the addition of molybdenum element causes the steel plate to have a solid solution strengthening effect, thereby improving the hardness and strength of the steel. In the bulletproof steel plate of the present invention, the content of Mo element should be set to 0.20-0.80%.

Copper: Cu is mainly present in the form of solid solution in the steel, and has a function of solid solution strengthening. Furthermore, the addition of 0.20-0.60% of Cu to the bulletproof steel plate of the present invention can remarkably improve the atmospheric corrosion resistance of the steel plate.

Titanium: Ti can form titanium carbide, titanium nitride or titanium carbonitride with C and N in the steel and has the function of refining austenite grains in the stage of heating and hot-rolling the steel blank, thereby improving the strength and toughness of the steel plate. However, too much Ti will form more coarse titanium nitride, which negatively affects both the strength and toughness of the steel plate. In this regard, the bulletproof steel plate of the present invention, the content of Ti needs to be controlled at 0.01-0.05%.

Boron: The addition of B in a small amount can remarkably increase the hardenability of the steel, thus easily obtaining the martensite structure. With regard to the bulletproof steel plate of the present invention, the B element should not be added in a too large amount, because there is a strong binding force between B and the grain boundary, making this element easy to segregate to the grain boundary, thus affecting the performance of the steel plate. In this regard, with regard to the bulletproof steel plate of the present invention, not only can the addition of 0.001-0.003% of B improve the hardenability of the steel plate but also it can give the corresponding martensite microstructure.

Further, the microstructure of the bulletproof steel plate is tempered martensite+a very small amount of residual austenite. The tempered martensite is composed of martensite with a slightly lower degree of supersaturation and very fine ε-carbides.

More further, in the bulletproof steel plate of the present invention, the structural proportion of said residual austenite is less than 1%.

Further, among the unavoidable impurities in the bulletproof steel plate of the present invention, P≤0.010% and S≤0.005%. With regard to this technical solution, the inevitable impurities are mainly S and P.

Further, the thickness of the bulletproof steel plate of the present invention is 6-22 mm.

Another object of the present invention lies in providing a method for manufacturing a bulletproof steel plate. The bulletproof steel plate obtained by the manufacturing method has a higher tensile strength and a greater Brinell hardness, wherein the tensile strength can reach a grade of 2000 MPa, and the Brinell hardness can reach a grade of 600. In addition, the bulletproof steel plate obtained by the manufacturing method further has an excellent atmospheric corrosion resistance.

In order to achieve the above-mentioned object of the present invention, the method for manufacturing the bulletproof steel plate as disclosed in the present invention comprises the following steps in sequence: (1) smelting and casting; (2) heating; (3) rolling; (4) cooling; (5) quenching; and (6) low temperature tempering.

Further, in step (2) of the above-mentioned method for manufacturing the bulletproof steel plate, the heating temperature is 1130-1250° C. and the heating time is 120-180 min.

More further, in step (3) of the above-mentioned method for manufacturing the bulletproof steel plate, the finish rolling temperature is controlled at 950-1050° C. so as to reduce the deformation resistance in the rolling stage.

Further, in step (4) of the above-mentioned method for manufacturing the bulletproof steel plate, the cooling method is air cooling.

Further, in step (5) of the above-mentioned method for manufacturing the bulletproof steel plate, the quenching temperature is 880-930° C. and the temperature holding time is plate thickness×(2-3) min/mm so as to ensure that the steel plate enters into an austenitizing zone.

More further, in step (6) of the above-mentioned method for manufacturing the bulletproof steel plate, the tempering temperature is 180-220° C. and the temperature holding time is plate thickness×(3-5) min/mm so as to achieve a purpose of stress relieving.

Due to the rational design of the addition of alloying elements, the bulletproof steel plate of the present invention has a high tensile strength that can reach a grade of 2000 MPa. Moreover, the bulletproof steel plate has a great Brinell hardness that can reach a grade of 600.

Furthermore, the bulletproof steel plate of the present invention has an excellent atmospheric corrosion resistance.

In addition, compared with bulletproof steel plates with a thickness not exceeding 3 mm in the prior art, the thickness of the bulletproof steel plate of the present invention can reach 6-22 mm, so the steel plate has better bulletproofing and puncture-resistant capabilities.

The bulletproofing performance of the bulletproof steel plate of the present invention can meet the standard requirements of FB5 grade in EU standard EN.1063.

According to the method for manufacturing a bulletproof steel plate of the present invention, a bulletproof steel plate having a high tensile strength and a great Brinell hardness can be obtained.

DETAILED DESCRIPTION OF EMBODIMENTS

Figure 1:
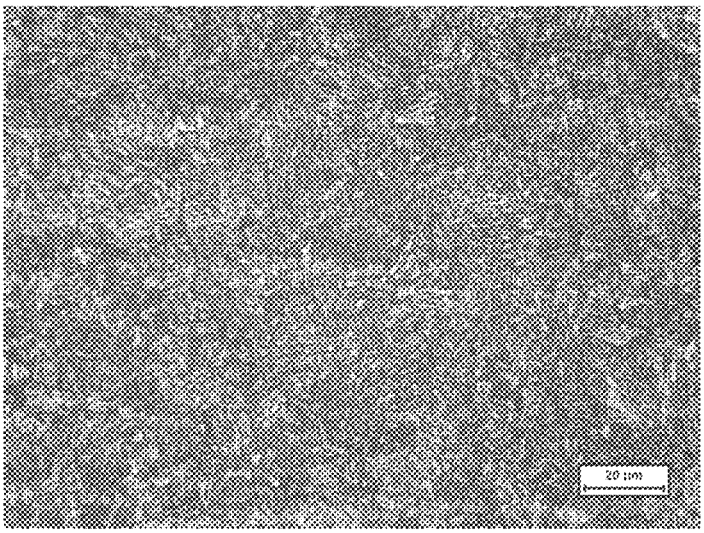
FIG. 1 shows the metallographic structure of a bulletproof steel plate of Example 4 with a 500-fold magnification under an optical microscope.

The bulletproof steel plate and the manufacturing method for the bulletproof steel plate according to the present invention will be further explained and illustrated in conjunction with the accompanying drawings and specific examples below; however, the explanation and illustration do not unduly limit the technical solution of the present invention.

Examples 1-6

Table 1 lists the mass percentages of the chemical elements in the bulletproof steel plates of Examples 1-6.

TABLE 1

(wt. %, the balance being Fe and inevitable impurity elements)

| Number | C | Si | Mn | Al | Ni | Cr | Mo | Cu | Ti | B | Plate thickness (mm) |
|---|---|---|---|---|---|---|---|---|---|---|---|
| 1 | 0.36 | 1.55 | 0.41 | 0.034 | 0.40 | 0.39 | 0.30 | 0.40 | 0.023 | 0.0015 | 6 |
| 2 | 0.38 | 0.95 | 0.64 | 0.047 | 0.55 | 0.94 | 0.55 | 0.26 | 0.034 | 0.0022 | 8 |
| 3 | 0.40 | 1.36 | 0.80 | 0.038 | 0.46 | 0.46 | 0.28 | 0.55 | 0.034 | 0.0026 | 10 |
| 4 | 0.42 | 1.45 | 0.95 | 0.042 | 0.33 | 0.76 | 0.34 | 0.48 | 0.015 | 0.0016 | 15 |
| 5 | 0.42 | 0.85 | 0.50 | 0.045 | 0.97 | 0.95 | 0.67 | 0.39 | 0.045 | 0.0019 | 18 |
| 6 | 0.44 | 1.50 | 0.65 | 0.040 | 1.17 | 0.70 | 0.75 | 0.25 | 0.028 | 0.0020 | 22 |

The bulletproof steel plates in Examples 1-6 mentioned above are manufactured by the following steps in sequence:

(1) smelting and casting;

(2) heating: the heating temperature is 1130-1250° C. and the heating time is 120-180 min;

(3) rolling: the finish rolling temperature is controlled at 950-1050° C.;

(4) cooling: the cooling method is air cooling;

(5) quenching: the quenching temperature is 880-930° C. and the temperature holding time is plate thickness×(2-3) min/mm; and (6) low temperature tempering: the tempering temperature is 180-220° C. and the temperature holding time is plate thickness×(3-5) min/mm.

Table 2 lists the specific process parameters of the method for manufacturing the bulletproof steel plates in Examples 1-6.

TABLE 2

| Number | Step (2) Heating temperature (° C.) | Step (2) Heating time (min) | Step (3) Finish rolling temperature (° C.) | Step (5) Quenching temperature (° C.) | Step (5) Temperature holding time* (min) | Step (6) Quenching temperature (° C.) | Step (6) Temperature holding time* (min) |
|---|---|---|---|---|---|---|---|
| 1 | 1250 | 120 | 980 | 900 | 12 | 200 | 20 |
| 2 | 1250 | 180 | 1000 | 890 | 18 | 190 | 30 |
| 3 | 1200 | 120 | 1010 | 880 | 30 | 180 | 40 |
| 4 | 1200 | 150 | 980 | 920 | 30 | 210 | 60 |
| 5 | 1180 | 180 | 980 | 930 | 40 | 220 | 70 |
| 6 | 1130 | 120 | 975 | 900 | 50 | 210 | 80 |

Note:
the temperature holding time in step (5) is plate thickness × (2-3) min/mm, and the temperature holding time in step (6) is plate thickness × (3-5) min/mm.

After sampling the bulletproof steel plates of Examples 1-6, the samples are subjected to a steel plate shooting test according to the requirements of FB5 grade in EU standard EN.1063, with the test conditions and results both being listed in Table 3.

Table 3 lists the results of the bulletproof steel plates of Examples 1-6 after a shooting test.

TABLE 3

| Number | Shooting distance/m | Shooting speed/m/s | Result |
|---|---|---|---|
| 1 | 10 | 982/984/981 | Not punctured |
| 2 | 10 | 983/984/981 | Not punctured |
| 3 | 10 | 983/982/981 | Not punctured |
| 4 | 10 | 985/983/984 | Not punctured |
| 5 | 10 | 980/982/981 | Not punctured |
| 6 | 10 | 983/985/984 | Not punctured |

It can be seen from Table 3 that none of the bulletproof steel plates of Examples 1-6 is punctured in the shooting test, so the bulletproof steel plates of the above-mentioned examples all satisfy the requirements of FB5 grade in EU standard EN.1063.

After sampling the bulletproof steel plates of Examples 1-6, the samples are subjected to tensile strength and Brinell hardness tests, and the test results are all listed in Table 4.

Table 4 Tensile strength and Brinell hardness of the bulletproof steel plates of Examples 1-6.

TABLE 4

| Number | Brinell hardness (MPa) | Tensile strength (MPa) |
|---|---|---|
| 1 | 590 | 2030 |
| 2 | 587 | 2020 |
| 3 | 594 | 2120 |
| 4 | 600 | 2140 |
| 5 | 592 | 2038 |
| 6 | 598 | 2136 |

It can be seen from Table 4 that the Brinell hardnesses of the bulletproof steel plates of Examples 1-6 all reach a grade of 600 and the tensile strengths are all greater than 2000 MPa.

Figure 2:
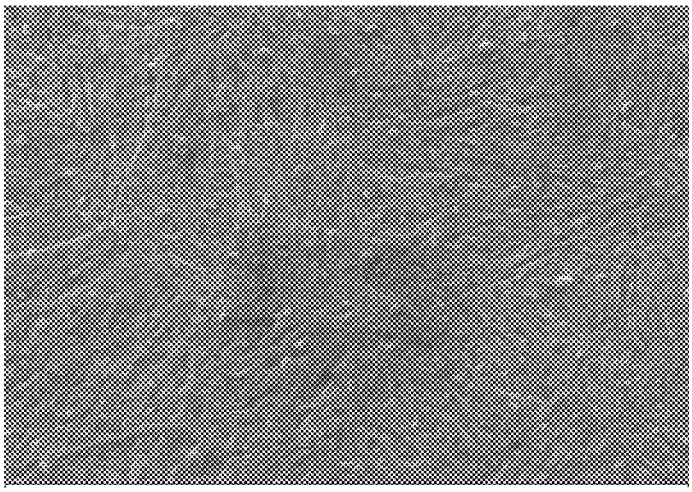
FIG. 2 shows the metallographic structure of a bulletproof steel plate of Example 4 with a 5000-fold magnification under a scanning electron microscope.

FIGS. 1 and 2 respectively show the metallographic structure of the bulletproof steel plate of Example 4 with a 500-fold magnification under an optical microscope and the metallographic structure of the bulletproof steel plate with a 5000-fold magnification under a scanning electron microscope; and it can be seen from FIGS. 1 and 2 that the microstructure of the bulletproof steel plate is mainly tempered martensite, with the content of residual austenite being very low.

It can be seen therefrom that the technical solution of the present invention gives a bulletproof steel plate with an ultrahigh tensile strength and an ultrahigh Brinell hardness by means of an alloying element design+a rational manufacturing process.

It should be noted that the examples listed above are only the specific examples of the present invention, and obviously the present invention is not limited to the above examples and can have many similar changes. All variations which can be directly derived from or associated with the disclosure of the invention by those skilled in the art should be within the scope of protection of the present invention.

The invention claimed is:

1. A bulletproof steel plate with a tensile strength of greater than 2000 MPa and a Brinell Hardness of greater than or equal to 587 MPa, said bulletproof steel plate consisting of the chemical elements in mass percentage thereof being:

0.35-0.45% of C, 0.80-1.60% of Si, 0.3-1.0% of Mn, 0.02-0.06% of Al, 0.3-1.2% of Ni, 0.30-1.00% of Cr, 0.20-0.80% of Mo, 0.20-0.60% of Cu, 0.01-0.05% of Ti, 0.001-0.003% of B, and the balance being Fe and inevitable impurities; and wherein the microstructure of the bulletproof steel plate consists of tempered martensite and less than 1% residual austenite.

2. The bulletproof steel plate according to claim 1, wherein said inevitable impurities comprises P 0.010% and S 0.005%.

3. The bulletproof steel plate according to claim 1, wherein the bulletproof steel plate is 6-22 mm in thickness.

4. A method for manufacturing the bulletproof steel plate of claim 1 comprises the following steps in sequence: (1) smelting and casting; (2) heating; (3) rolling; (4) cooling; (5) quenching; and (6) low temperature tempering;

wherein in said step (5), the quenching temperature is 880-930° C. and the temperature holding time is plate thickness x (2-3) min/mm; and in said step (6), the tempering temperature is 180-220° C. and the temperature holding time is plate thickness x (3-5) min/mm.

5. The manufacturing method of claim 4, wherein in said step (2), the heating temperature is 1130-1250° C. and the heating time is 120-180 min.

6. The manufacturing method of claim 4, that wherein in said step (3), the finish rolling temperature is controlled at 950-1050° C.

7. The manufacturing method of claim 4, wherein in said step (4), the cooling method is air cooling.

* * * * *